United States Patent [19]

Tarantola

[11] 4,195,469

[45] Apr. 1, 1980

[54] METHOD AND DEVICE FOR PRODUCING METALLIC CORDS

[75] Inventor: Luciano Tarantola, Milan, Italy

[73] Assignee: Industrie Pirelli S.p.A., Milan, Italy

[21] Appl. No.: 894,522

[22] Filed: Apr. 7, 1978

[30] Foreign Application Priority Data

Apr. 8, 1977 [IT] Italy ..... 22266 A/77

[51] Int. Cl.[2] ..... D07B 3/00

[52] U.S. Cl. ..... 57/311; 57/58.3; 140/149

[58] Field of Search ..... 57/9, 55, 138, 311, 57/58.3, 58.36; 140/149

[56] References Cited

U.S. PATENT DOCUMENTS

| | | | |
|---|---|---|---|
| 1,712,264 | 5/1929 | Gammeter | 57/9 |
| 2,811,010 | 10/1957 | Balint, Sr. | 57/9 |
| 3,037,343 | 6/1962 | Haas et al. | 57/9 |
| 3,130,534 | 4/1964 | Osterman | 57/9 |
| 3,388,541 | 6/1968 | Biagini | 57/9 |
| 3,446,001 | 5/1969 | Akachi | 57/311 X |
| 3,641,755 | 2/1972 | Heinen et al. | 57/9 |
| 3,720,054 | 3/1973 | Haehnel et al. | 57/9 |

*Primary Examiner*—John Petrakes

*Attorney, Agent, or Firm*—Stevens, Davis, Miller & Mosher

[57] ABSTRACT

A method is provided for making metal cords to be used as reinforcing elements in elastomeric structures which comprises arranging the wires in groups with the wires of each group being arranged coplanar and side by side, permanently deforming the wires by bending to wind the wires in a regular and uniform helical arrangement, with the helexes of all the wires having the same geometrical characteristics. The resulting cord is free from residual tensions which might loosen the mutual strand.

10 Claims, 6 Drawing Figures

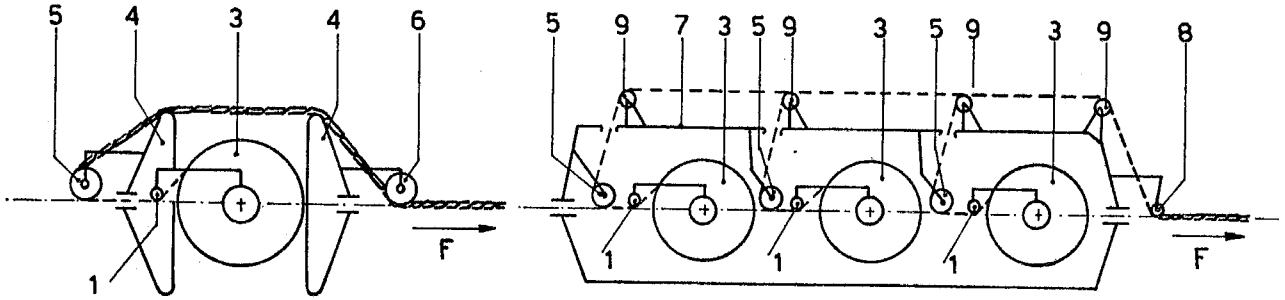
FIG. 3
FIG. 4
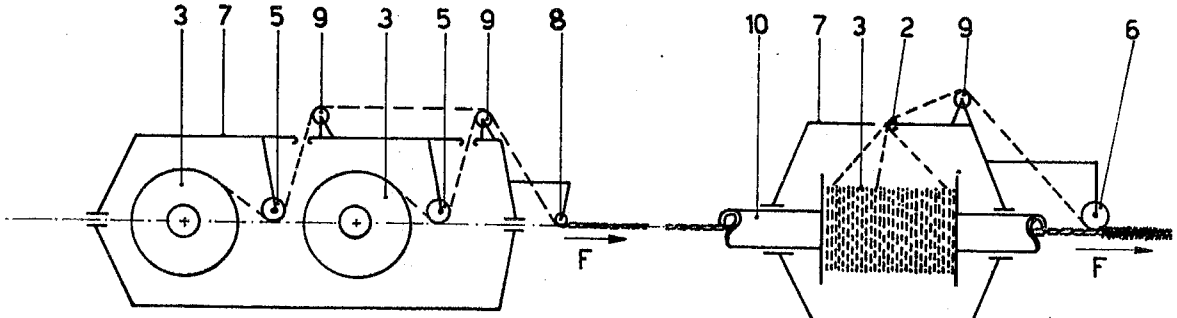
FIG. 5
FIG. 6

METHOD AND DEVICE FOR PRODUCING METALLIC CORDS

The present invention relates to a method and an apparatus for stranding together metal wires, either individual separate wires or strands of a plurality of wires, in order to produce metal cords of any kind. The method and the apparatus are especially well adapted for making metal cords to be used for reinforcing elastomeric articles such as pneumatic tires, conveyor bands, belts and the like.

As it is known, the base element for the production of a metal cord is a steel wire which, in the present description, will be indicated as the "elementary wire". Several elementary wires are stranded together in a helical arrangement to form a cord suitable for reinforcing one of the above articles.

Several cords, which in that case are usually called "strands", may be stranded together in the same way that the elementary wires are stranded or cabled in order to form a cord having a more complex structure.

Depending on whether the stranding sense of the strand is the same or opposite with respect to the stranding sense of the elementary wires, the cords are indicated as "lang lay" or "regular lay".

Moreover, if the elementary wires are all helically stranded together, the resulting cords are defined as "coreless". On the other hand, if the elementary wires are wound up about a rectilinear central element, as an elementary wire or a strand, they are defined as "core-provided".

Substantially, the geometry of the cords may be varied, depending upon the features which they must have for their specific employment. Therefore, there are the "$a \times n \times D$" type cords, where "a" indicates the number of strands, "n" the number of the elementary wires forming the strand and "D" the diameter of the elementary wire (for instance a "$1 \times 4 \times 0.20$" type cord, namely one formed by four elementary wires stranded together, each of which has a diameter of 0.20 mm, or else a "$7 \times 3 \times 0.18$" type cord, namely one formed by seven strands, each constituted by three elementary wires each having a diameter of 0.18 mm), or the "$b+a \times n \times D$" type cords, where "b" indicates the number of strands forming the core (for instance a "$3+5 \times 7 \times 0.15$" type cord, namely one having a core formed by 3 strands stranded or cabled together and a crown of 5 strands, each of which is formed by 7 elementary wires.

Apart from the above brief description intended to better define the field of the present invention, these aspects, not specifically pertinent to the invention itself, will no longer be taken into account. On the contrary, it is pointed out that, whichever type cord is to be produced, the main operation involves imparting to the elementary wires or to the strands a deformation which facilitates forming them into the desired helical arrangement. This arrangement must be acquired permanently, since otherwise, owing to the peculiar elasticity of steel, the cord will loosen up.

Of course, the operation may be carried out several times during the cord formation process. For instance at first on the elementary wires to be stranded to form a strand, and then on the strands to be grouped to form the cord.

Therefore, in the following description, the invention is described with reference to "wires". The expression is intended to indicate the elements which are to be stranded and which must consequently suffer the deformation, be they elementary wires, strands or stranded cords.

In order to obtain the permanent helical arrangement, it is then necessary to deform the wire over its yield point, imparting to it a permanent deformation. However, this is not sufficient in view of a good qualitative result of the produced cords. In fact, owing to the comparatively high value of their diameter and their limited number, the steel wires cannot be stranded together at random, but are to be positioned in the cord section according to a regular and well defined geometrical figure.

As regards the application of the permanent deformation, it is obtained by means of an operation preceding the stranding operation, which is usually called "pre-formation".

This helical arrangement can be the result of two different types of permanent deformation: deformation of the wire by bending only, or by simultaneous bending and torsional deformation, which in the following description will be simply referred to as "torsional" to distinguish it from "bending" deformation, the co-existence of "bending" being anyhow implicit. In fact, it is clear that torsional deformation by itself does not allow in any way the mutual stranding of various wires.

Two types of machines capable of producing metal cords are widely in use. The so-called "laying" machines prevailingly employed for the production of core-provided cords, which give rise to bending deformations only, and the so-called "twisting" machines, having the advantage of a greater output, which give rise to torsional deformations.

However, the machines which are at present in use, which are capable of imparting to the wire a permanent deformation which gives to it a helical arrangement, are instead unable to locate these deformations on the wires in such a way that in the section of the produced cord the wires are correctly positioned, just as desired, according to a regular and well defined geometrical figure.

In many cases, the result is an irregular cord which has some drawbacks, as for instance wire crossings or pitch skips, well known to those skilled in the art, size variations, concentration of stresses and localized deformations which prejudice the quality of the finished cord and require a series of additional steps for their elimination, which result in a serious torture of the material and, of course, in higher production costs.

An object of the present invention is to provide a "pre-formation" method, and apparatus for carrying out the mutual helical stranding of wires in a uniform and regular arrangement so as to eliminate all the above stated disadvantages and to allow the production of metal cords having high qualitative characteristics.

Other objects will become apparent from the following description with reference to the accompanying drawings wherein:

FIG. 3 illustrates an application of the apparatus in a stranding machine of the "double-twist" type;

Figure 1:
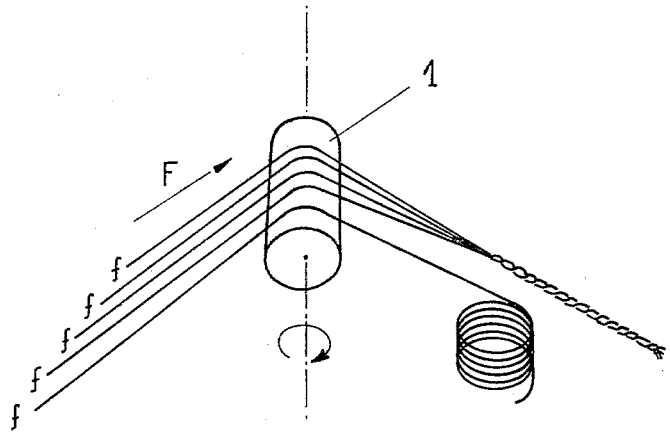
FIG. 1 illustrates an apparatus provided by the invention in a roller-type embodiment.

FIG. 4, like FIG. 3, illustrates an apparatus in the so-called "torpedo" machines, for the production of multi-stranded cords in a single pass;

FIG. 5, like FIG. 3, illustrates the apparatus in a stranding machine of the "laying" type;

FIG. 6, like FIG. 3, illustrates the apparatus in a particular machine for the production of cords having a core.

The foregoing objects and others are accomplished in accordance with this invention by providing a method for producing metal cords adapted to be used as reinforcing elements in elastomer-containing structures, starting from one or more groups of two or more metal wires, wound up on one or more feeding bobbins, said metal wires being elementary wires, i.e., individual metal wires, or strands, i.e., groups of elementary wires stranded together, the method comprising the steps of:

applying to the wires a force able to unwind them from the feeding bobbin or bobbins by dragging them in a so-called "advancement direction";

deforming permanently, at least by bending, each of the wires of the groups;

conferring simultaneously to the wires of each group a rotation having the aim of stranding the wires together, to group them according to a helical arrangement, obtained and maintained by the permanent deformation by bending, the method being characterized in that it comprises the steps of:

arranging the wires of each group co-planar and side-by-side; causing simultaneously in each of the wires while coplanar and mutually side-by-side, an equal permanent deformation by bending only so that they are mutually wound up automatically according to a regular and uniform helical arrangement, said wires, at any point of the resulting cord, being parallel to one another, the helices of all wires showing the same geometrical characteristics and the resulting cord being devoid of residual tensions which might loosen said mutual strand.

According to one embodiment of this method, the permanent deformation by bending is obtained by varying, at the same time and in the same way, the advancement direction of each wire by causing the wire to be diverted about the surface of a rigid element having a profile capable of originating the permanent deformation.

In particular, a preferred solution consists in diverted said wires—coplanar and placed side-by-side—about only one surface, curved in the direction of advancement of the wires, and revolving about its own axis, orthogonal to the advancement direction at a peripheral speed equal to the advancement speed of the wires.

The invention also provides a machine for the production of metal cords, adapted to be used as reinforcing elements in an elastomer-containing structure, starting from at least one group of two or more metal wires, wound up on one or more feeding bobbins, the metal wires being both elementary wires, i.e., individual metal wires, or strands, i.e., groups of elementary wires stranded together, said machine comprising:

means for supporting the feeding bobbin or bobbins; means for unwinding the wires from the bobbins for dragging them through the parts forming the machine in the so-called advancement direction and for taking up the so produced metal cord;

means for conferring to each of said wires a permanent deformation by process bending;

means for imparting simultaneously to the wires of each group a rotation intended to strand them together, grouping them according to a helical arrangement;

said machine being characterized in that said means for conferring said permanent deformation comprise a so-called "pre-forming" device having a coupling surface, for the wires of each group, whose shape is able to convey the wires in a single lying plane in side-by-side position and to cause at the same time in each of said coplanar and side-by-side positioned wires an equal permanent deformation by bending only, said "pre-forming" device being situated, with respect to the direction of advancement of said wires, either at or upstream said means for imparting said stranding rotation.

According to an advantageous embodiment of the apparatus, the coupling surface is straight in a first direction and curved in a direction perpendicular to the first, the curve having, in at least a point of its development, a bending radius of a value not greater than that which originates in said wires by permanent deformation by bending.

In particular, the "pre-forming" apparatus can be a small bar provided with the above described coupling surface situated with the first straight portion transverse to the direction of advancement of the wires and fixed with respect to them, or can be a roller, revolving about its own axis, constructed and positioned in compliance with the above indications, or at least it can be constituted by an appropriate shaping obtained on one of the parts forming the stranding machine.

We refer now to FIG. 1, which illustrates the apparatus of the invention, hereinafter called "pre-former", in the roller-type embodiment used for the production of a $1\times4$ type cord.

The apparatus has a small cylinder 1, whose axis is sensibly orthogonal to the direction of advancement of a group of four elementary wires, f, plus a fifth wire which will be considered later.

The relative friction between the elementary wires and the roller is appropriately avoided by rotating the roller at a peripheral speed equal to the advancement speed of the wires.

It is necessary to deform by bending the elementary wires over the yield point in order to obtain their arrangement along a cylindrical helix.

At this time, it is clear that the main feature of the roller will be that of having a bending radius, obviously depending on the diameter of the wires to be stranded, of such a value as to induce into said wires the required permanent deformation by bending.

More precisely, the bending radius also depends on the tension stress exerted on the wire; however, in connection with the tensions normally adopted in this specific technological branch, the effects of said dependency are considerably smaller than those related to the wire diameter, so that, in conclusion, they might be neglected.

FIG. 1 shows also a fifth wire, separate from the other four, to bring into evidence the helical configuration which it takes during permanent deformation by bending.

It is clear that, if a tension is exerted on the wire, as for instance the one necessary to unwind it from its feeding bobbin and to drag it through the stranding plant, like is done for the other four wires, and as will be explained hereinafter, the helix elongates in the axial direction, maintaining its own shape. Moreover, if there are at least two wires which simultaneously suffer the phenomenon, and if they are stranded together, as the four indicated above, their helices penetrate the one into the other, giving rise to their stranding.

On the roller of FIG. 1, the illustrated wires are not only subjected simultaneously to a permanent deformation, but the latter is identical both as regards its absolute value and its space location, so that all equal and all equally positioned helices are obtained.

It has been found surprisingly that, if such deformed wires are stranded together, the resulting cords are compact, extremely uniform and regular and substantially free from the above indicated drawbacks.

This equality of the cylindrical helices is therefore obtained by causing wires which are coplanar to one another and, preferably, are parallel, to be deformed by passing around a curved surface which varies their advancement direction, the surface having equal geometrical characteristics along the contact lines of each wire, and in particular an identical bending radius. The use of the above described pre-forming roller constitutes the preferred method of obtaining the desired technical effect; however, other methods are possible, which time by time can be more conveniently selected in view of certain particular aspects, as for instance the economical one, although this might be detrimental for other features of minor importance in that particular case.

The pre-forming device has a surface which is straight at least along a line transverse to the direction of advancement of the wires and which is curved, with the same geometrical and dimensional characteristics, in a direction orthogonal to the first, namely approximately along the line of advancement of the wires.

On the basis of the above, various alternative embodiments can be made to the pre-forming device provided by the present invention.

Figure 2:
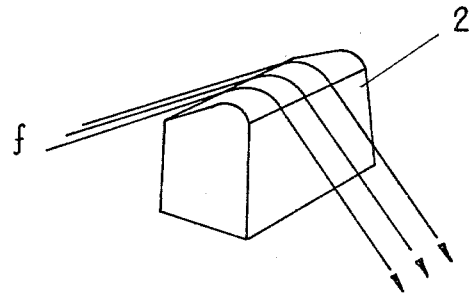
FIG. 2 illustrates the apparatus according to the invention in a bar-type embodiment.

One of these is represented in FIG. 2, where the pre-forming roller has become a simple small bar 2, whose contact surface with said wires, now sliding onto it, has an appropriate curvature.

Theoretically, this curvature could be enhanced until it becomes a sharp edge, but normally this solution is not feasible because the sharp edge, as known, damages the wire in a way which is undesireable for the desired purpose.

The device of FIG. 2 is interesting, because, if the small bar is considered as the outer edge of any mechanical element making part of the stranding machine, or as the inner edge of an opening obtained in the wall of the hollow mechanical elements, the possibility can be immediately seen of obtaining the desired preformation without using additional elements in the stranding machine, like the pre-forming roller 1 or the small bar 2, but exploiting instead mechanical elements already present and necessary.

FIGS. 3 to 6 illustrate various examples of employment of the pre-forming device according to the invention in the most widely used types of stranding machines; therefore it will be easy for any technician of this field to apply the same inventive concept also on the not expressly illustrated machines.

The usefulness and the function of the pre-forming device having already been pointed out so no further reference will be made to this topic. The topographical position of the pre-forming device in the machines will be instead illustrated, with regard to its reasons and advantages.

FIG. 3 represents a generic "double-twist" machine, substantially constituted by a wire-feeding bobbin 3, supported by known members not illustrated and comprised between two discs 4, fast during rotation, which rotate about an axis normal to the axis of the bobbin 3: the latter rotates on its own axis but is fixed with respect to the axis of the discs.

Each disc is integral with a return roller, 5 and 6, respectively, while a pre-forming roller 1 is positioned between the bobbin and the roller 5, with its axis parallel to that of the bobbin and connected to the latter so that it, too, is fixed with respect to the discs axis; obviously, however, it rotates around its own axis.

The described machine serves to produce metal cords of the $1 \times n \times D$ type, n being the number of wires and D their diameter, as explained above.

In the illustrated machine, only one bobbin is provided, obviously with n ends. It is, however, understood that n bobbins having 1 or more ends can be used.

The method for producing the metal cord is also known.

By means of an apparatus for taking up the produced cord, not shown, an appropriate dragging force is applied to the wires, which, in this case, are therefore unwound from the feeding bobbin in a direction opposite to the advancement direction F of the finished cord.

Said wires, in side-by-side arrangement, and substantially parallel to one another, reach the pre-forming device 1, where they are subjected to the above indicated permanent deformation. They are then wound up about the return roller 5, where they invert their advancement direction and, passing on the edge of the discs 4, are driven to the return roller 6, from whose outlet comes the finished cord.

During the machine operation, the discs, together with the rollers 5 and 6, are kept rotating; the wires unwound from bobbin 3 suffer therefore a first twist, with the relative stranding, on roller 5, and the so formed cord suffers a second twist, having the same sense as the first, on roller 6.

It is clear that, owing to the presence of the preforming device according to the invention, the stranding of the wires on roller 5 takes place according to the described modalities and gives rise to a cord possessing the above specified advantageous qualitative characteristics.

Now, it is easy to understand the use of the pre-forming roller also in the stranding machine shown in FIG. 4, employed for producing stranded cords of the $a \times n \times D$ type, in which "a", of a value greater than one, indicates the number of strands.

As regards the machine of the Figure, of the so-called "torpedo" type, which can be regarded as the combination of some parts of the preceding machine and in which elements like those of FIG. 3 have like reference numerals, "a" is equal to 3.

In fact, the machine comprises three wire-feeding bobbins 3, with "n" ends, each forming a strand; these bobbins are contained in a cylinder 7 (torpedo), are supported by known means not illustrated, are arranged with their axis orthogonal to that of the cylinder and are each connected to a pre-forming roller 1, having its axis parallel to that of the corresponding bobbin 3.

The cylinder, rotating during operation, is provided with return rollers 5 and 9 (the latter, however, might be omitted), with appropriate slits in its surface, through which the strands produced inside the torpedo are brought outside it, in a way known per se, and with a further pre-forming and return roller 8, the whole arranged as in the figure.

The operation is understandable: the "n" ends unwound from each bobbin are pre-formed on roller 1, then they are stranded together on roller 5. The so formed strands are brought outside the torpedo, caused to run along a generatrix of the latter, and are guided, in parallel and coplanar relationship, on the additional pre-forming roller 8, which effects simultaneously the permanent deformation and the stranding of said strands.

FIG. 5 illustrates a machine of the "laying" type, for which reference is made to the same reference numerals indicated in FIG. 4; also its operation is substantially the same and already known.

The difference in the operating system resides in the fact that in this case the wires are unwound from the feeding bobbins 3 (here having only one end) in the same advancement direction F of the finished cord. Consequently, the twist suffered by the wires on rollers 5 has a reverse sense, with respect to that suffered by them on the pre-forming roller 8, which becomes therefore an untwisting, so that the wire, tortured but not permanently twisted, is deformed only by bending in the finished cord.

It is clear that the cord is formed at the outlet of the pre-forming device 8, which carries out also the stranding of the wires, as already seen in connection with roller 8 of FIG. 4.

However, in this respect it is important to note that here the deformation by bending of the wire no longer takes place, as in the case of roller 1, along a generatrix of the wires; in consequence of the rotation of the wires on roller 8, the deformation occurs instead along a helix developed on the wire surface. This phenomenon allows the stranding both of the elementary wires, FIG. 5, and of the strands, FIG. 4, although in both cases the twisting action has not been imparted.

At least, FIG. 6 shows a machine of the "laying" type for the production of cords having a core; differently from the above described machines, the wire-feeding bobbin, having n ends, is arranged coaxial to cylinder 7 and is supported by a hollow shaft 10, in which passes the cord core, travelling in a direction F.

Both the bobbin and the cylinder rotate about their own axis, but of course at different speeds; the bobbin has a higher speed to be able to dispense the wire.

The wires wound up in this way are driven outside the cylinder by causing them to slide on the edge of the slit, comparable to a bar, which, by virtue of its shaping profile, represents the pre-forming device 2, which is therefore obtained by simply exploiting a mechanical element already present and necessary on the machine, without the addition of further means.

The pre-formed wires are then guided to the return roller 6 where by virtue of the rotation of the cylinder, and also of the roller axis, with respect to the core they are wound up about the latter substantially in the form of a sheath, giving rise to the typical formation of the cords of this kind.

Of course, also the latter machine might comprise the above described pre-forming roller, for instance in place of roller 6, or situated in any other point upstream of said roller, obviously not using the slit edge; it is moreover clear that, in all the above cited employments, the pre-forming roller can be replaced by bar 2, arranged as the roller but of course fixed.

Although the invention has been described in detail for the purpose of illustration, it is to be understood that such details is solely for that purpose and that variations can be made therein by those skilled in the art without departing from the spirit and scope of the invention except as it may be limited by the claims.

What is claimed is:

1. In a method for making metal cords adapted to be used for reinforcing elements in elastomeric structures, starting from at least one group of two or more metal wires, wound up on one or more feeding bobbins, said metal wires being individual metal wires or strands of wires stranded together, said method comprising the successive steps of:

applying to said wires a force capable of unwinding them from a feeding bobbin by pulling them in an advancement direction;

deforming permanently, by bending, each of the wires of said groups;

conferring simultaneously to the wires of each group a rotation which will strand the wires together in a helical arrangement which is obtained and maintained by said permanent deformation by bending;

the improvement wherein said step for obtaining the permanent deformation by bending comprises the phases of:

arranging the wires of each group coplanar and mutually side-by-side;

causing simultaneously in each of said wires a permanent deformation by bending only, equal both as regards its absolute value and its space location, said advancement direction lying in the same plane orthogonal to the plane containing said group of wires, at least in the portion of the trajectory of the wires along which the wires of each group pass from the coplanar and mutually side-by-side arrangement, to the stranded configuration, so that all equal and all equally positioned helices are obtained by said wires of the group.

2. The method of claim 1 wherein said permanent deformation by bending is produced by varying at the same time and in the same way the advancement direction of each wire by causing said wire to be diverted about only one surface of a rigid element having a profile capable of originating said permanent deformation.

3. The method of claim 2 wherein said wires while co-planar and side-by-side are diverted about only one surface, curved in the direction of advancement of said wires.

4. The method of claim 3 wherein said curved surface, which is a rotation surface arranged with its axis of rotation orthogonal to the direction of advancement of said wires is rotated about its own axis, at a peripheral speed equal to the wire advancement speed.

5. In a machine for the production of metal cords adapted to be used as reinforcing elements in an elastomer-containing structure, from at least one group of two or more metal wires, wound on one or more feeding bobbins, said metal wires being elementary wires or strands of elementary wires stranded together, said machine comprising:

means for supporting said feeding bobbin or bobbins;

means for unwinding the wires from the bobbins for pulling them through parts forming the machine in the advancement direction and for taking up resulting metal cord;

means for conferring to each of said wires a permanent deformation by process bending;

means for imparting simultaneously to the wires of each group a rotation which strands them together, grouping them according to a helical arrangement;

the improvement wherein said means for conferring said permanent deformation consist essentially of:

a pre-forming device having a coupling surface for said wires of each group, the shape of said surface being capable to convey said wires in a single lying plane in side-by-side position and to cause at the same time in each of said coplanar and side-by-side positioned wires an equal permanent deformation by bending only, said pre-forming device being disposed with respect to the direction of advancement of said wires at or upstream of said means for imparting said stranding rotation.

6. The machine of claim 5 wherein said coupling surface is straight in a first direction and is curved in a direction perpendicular to the first, said curve having in at least a point of its development a bending radius of a value not greater than that which originates in said wires said permanent deformation by bending.

7. The machine of claim 6 wherein said pre-forming device is a small bar, said coupling surface constituting at least a part of the outer surface of said small bar.

8. The machine of claim 7 characterized in that said device is arranged with said straight portion substantially orthogonal to the wire advancement direction.

9. The machine of claim 6 wherein said pre-forming device is a roller rotating about its own axis.

10. The machine of claim 6 wherein said pre-forming device is constituted by an appropriate shaping obtained on one of the parts forming the machine.

* * * * *